US011370631B2

(12) United States Patent
Noso

(10) Patent No.: US 11,370,631 B2
(45) Date of Patent: Jun. 28, 2022

(54) SHEET POST-PROCESSOR AND IMAGE FORMING SYSTEM

(71) Applicant: KYOCERA Document Solutions Inc., Osaka (JP)

(72) Inventor: Terumitsu Noso, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/340,749

(22) Filed: Jun. 7, 2021

(65) Prior Publication Data

US 2021/0387827 A1 Dec. 16, 2021

(30) Foreign Application Priority Data

Jun. 11, 2020 (JP) ..... JP2020-101743

(51) Int. Cl.

| | |
|---|---|
| ***B65H 31/34*** | (2006.01) |
| ***B65H 31/30*** | (2006.01) |
| ***B65H 29/14*** | (2006.01) |
| ***B42C 1/12*** | (2006.01) |

(52) U.S. Cl.

CPC ..... *B65H 31/3027* (2013.01); *B42C 1/12* (2013.01); *B65H 29/14* (2013.01); *B65H 2404/693* (2013.01)

(58) Field of Classification Search

CPC .... B65H 29/14; B65H 31/3027; B65H 31/34; B65H 2301/3613; B65H 2408/114; B65H 2408/1142; B65H 2404/693

USPC ..... 270/58.12, 58.17, 58.27

See application file for complete search history.

(56) References Cited

U.S. PATENT DOCUMENTS

| | | | | |
|---|---|---|---|---|
| 5,772,198 | A * | 6/1998 | Yamamoto | B42C 1/12 270/58.12 |
| 6,098,975 | A * | 8/2000 | Kobayashi | B42C 1/12 270/58.09 |
| 6,142,461 | A | 11/2000 | Asao et al. | 270/58.09 |
| 6,283,470 | B1 * | 9/2001 | Hirai | B65H 29/51 271/163 |
| 8,899,579 | B2 * | 12/2014 | Gamo | G03G 15/6552 271/218 |

(Continued)

FOREIGN PATENT DOCUMENTS

| | | |
|---|---|---|
| JP | H 11-157729 A | 6/1999 |
| JP | 2007-269488 A | 10/2007 |

*Primary Examiner* — Leslie A Nicholson, III

(74) *Attorney, Agent, or Firm* — Stein IP, LLC

(57) ABSTRACT

A sheet post-processor includes a processing tray, a sheet discharge port, a discharge roller pair, a pair of cursor members, a pair of support members, and an interlocking mechanism. The interlocking mechanism includes a pair of coupling members arranged in the processing tray so as to be reciprocatable in a sheet width direction. The pair of coupling members are coupled to or decoupled from the pair of cursor members in accordance with movement of the pair of cursor members. While being coupled to the pair of cursor members, the pair of coupling members contact the pair of support members so as to displace the pair of support members to a protruding position, and while being decoupled from the pair of cursor members, the pair of coupling members separate from the pair of support members so as to displace the pair of support members to a retracted position.

10 Claims, 9 Drawing Sheets

(56) References Cited

U.S. PATENT DOCUMENTS

| | | | | |
|---|---|---|---|---|
| 9,010,754 | B2 * | 4/2015 | Matsumoto | B65H 31/34<br>271/213 |
| 10,604,371 | B2 * | 3/2020 | Kotani | B65H 31/26 |

* cited by examiner

SHEET POST-PROCESSOR AND IMAGE FORMING SYSTEM

INCORPORATION BY REFERENCE

This application is based upon and claims the benefit of priority from the corresponding Japanese Patent Application No. 2020-101743 filed on Jun. 11, 2020, the entire contents of which are incorporated herein by reference.

BACKGROUND

The present disclosure relates to a sheet post-processor for an image forming apparatus and to an image forming system including the sheet post-processor.

There is known a sheet post-processor including a post-processing mechanism that performs post-processing such as a stapling process or a perforation process with respect to a sheet that has been subjected to image formation. The sheet post-processor includes a processing tray on which a sheet to be subjected to post-processing is loaded and a sheet discharge port arranged on a downstream side in a sheet discharge direction relative to the processing tray.

In the sheet post-processor, during an operation of conveying a sheet to the processing tray, when the sheet is of a size larger than that of the processing tray, it might temporarily hang outside the sheet discharge port over a wide area, or when the sheet is bent in a Z-shape, a Z-shaped part of the sheet might temporarily extend out through the sheet discharge port. This has led to a trouble that the sheet might become partly caught in the sheet discharge port, failing to be conveyed to a prescribed position on the processing tray.

SUMMARY

A sheet post-processor according to one aspect of the present disclosure includes a processing tray, a sheet discharge port, a discharge roller pair, a pair of cursor members, a pair of support members, and an interlocking mechanism. A sheet is loaded on the processing tray. The sheet discharge port is arranged on a downstream side in a sheet discharge direction relative to the processing tray. The discharge roller pair is arranged at the sheet discharge port and discharges the sheet on the processing tray. The pair of cursor members is arranged along an upper surface of the processing tray so as to be reciprocatable in a sheet width direction orthogonal to the sheet discharge direction and contacts side end edges of the sheet on the processing tray so as to align a position of the sheet in the sheet width direction. The pair of support members is displaced between a retracted position retracted from the sheet discharge port to an upstream side in the sheet discharge direction and a protruding position protruding to a downstream side beyond the sheet discharge port in the sheet discharge direction, at which an upper surface of the pair of support members is contacted by the sheet discharged through the sheet discharge port. The interlocking mechanism causes the pair of support members to be displaced to the protruding position or the retracted position in accordance with movement of the pair of cursor members. The interlocking mechanism includes a pair of coupling members. The pair of coupling members is arranged in the processing tray so as to be reciprocatable in the sheet width direction, and the pair of coupling members is coupled to or decoupled from the pair of cursor members in accordance with movement of the pair of cursor members. In a state of being coupled to the pair of cursor members, the pair of coupling members contacts the pair of support members so as to displace the pair of support members to the protruding position, and in a state of being decoupled from the pair of cursor members, the pair of coupling members separates from the pair of support members so as to displace the pair of support members to the retracted position.

DETAILED DESCRIPTION

The following describes an embodiment of the present disclosure with reference to the appended drawings. The present disclosure, however, is not limited to configurations described below.

Figure 1:
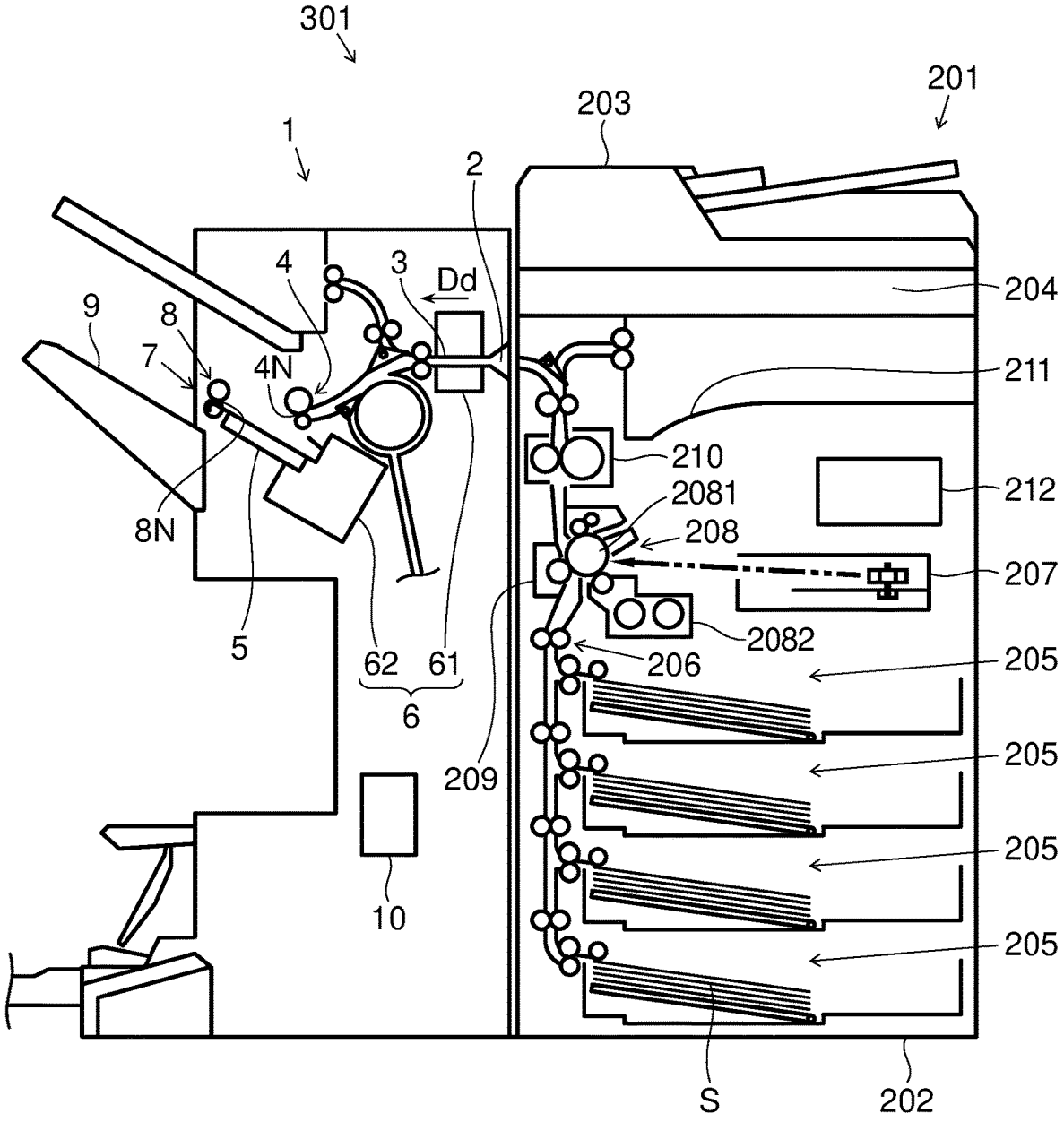
FIG. 1 is a sectional front view showing a schematic configuration of an image forming system according to an embodiment of the present disclosure.

FIG. 1 is a sectional front view showing a schematic configuration of an image forming system 301 according to the embodiment. As shown in FIG. 1, the image forming system 301 includes an image forming apparatus 201 and a sheet post-processor 1.

The image forming apparatus 201 is, for example, a so-called multi-functional peripheral for monochrome image formation having functions of printing, scanning (image reading), facsimile transmission, and so on. The image forming apparatus 201 may be an apparatus such as, for example, a copy machine or a printer or may be an image forming apparatus for color image formation.

As shown in FIG. 1, the image forming apparatus 201 includes an original document conveyance portion 203 placed on an upper surface of a main body 202 thereof and an image reading portion 204 provided in an interior of the main body 202 below the original document conveyance portion 203. An image of an original document loaded in the original document conveyance portion 203 or an image of an original document placed on a contact glass (not shown) on an upper surface of the image reading portion 204 is read by the image reading portion 204.

The image forming apparatus 201 further includes sheet feed portions 205, a sheet conveyance portion 206, an exposure portion 207, an image forming portion 208, a transfer portion 209, a fixing portion 210, a sheet discharge portion 211, and a main body control portion 212.

The sheet feed portions 205 each contain a plurality of sheets S before being subjected to printing and feed them separately one by one during printing. The sheet conveyance portion 206 conveys such a sheet S fed from any of the sheet feed portions 205 to the transfer portion 209 and the fixing portion 210 and further sorts the sheet S that has been subjected to fixing into the sheet discharge portion 211 or the sheet post-processor 1. The exposure portion 207 applies laser light controlled based on image data toward the image forming portion 208.

The image forming portion 208 includes a photosensitive drum 2081 that is an image carrier and a developing device 2082. In the image forming portion 208, by use of laser light applied from the exposure portion 207, an electrostatic latent image of an original document image is formed on a surface of the photosensitive drum 2081. The developing device 2082 supplies toner to the electrostatic latent image on the surface of the photosensitive drum 2081 so as to develop the electrostatic latent image into a toner image. The transfer portion 209 transfers the toner image on the surface of the photosensitive drum 2081 to the sheet S. The fixing portion 210 heats and presses the sheet S on which the toner image has been transferred so as to fix the toner image to the sheet S.

The sheet S on which the toner image has been fixed to complete printing thereon is conveyed to the sheet discharge portion 211 or the sheet post-processor 1. The sheet discharge portion 211 is arranged below the image reading portion 204. The sheet discharge portion 211 has an opening in front thereof and is configured so that a printed sheet (printed matter) is taken out from a front side. The sheet post-processor 1 will be described later.

The main body control portion 212 includes a CPU, an image processing portion, a storage portion, and other electronic circuits and electronic components (none of these are shown). Based on control programs and data stored in the storage portion, the CPU controls operations of the various constituent elements provided in the image forming apparatus 201 so as to perform processes related to functions of the image forming apparatus 201. The sheet feed portions 205, the sheet conveyance portion 206, the exposure portion 207, the image forming portion 208, the transfer portion 209, and the fixing portion 210 individually receive instructions from the main body control portion 212 to perform printing on the sheet S in tandem with each other. The storage portion is composed of, for example, a combination of a nonvolatile storage device such as a program ROM (read-only memory) or a data ROM and a volatile storage device such as a RAM (random-access memory), which are not shown.

The image forming apparatus 201 is configured as above to form an image on the sheet S and convey the sheet S on which the image has been formed to the sheet post-processor 1.

The sheet post-processor 1 is decouplably coupled to a side surface of the image forming apparatus 201. The sheet post-processor 1 is couplable not only to a multi-functional peripheral but also similarly to other types of apparatuses such as, for example, a copy machine and a printer. The sheet post-processor 1 performs post-processing with respect to the sheet S that has been subjected to image formation (printing) in the image forming apparatus 201.

Figure 2:
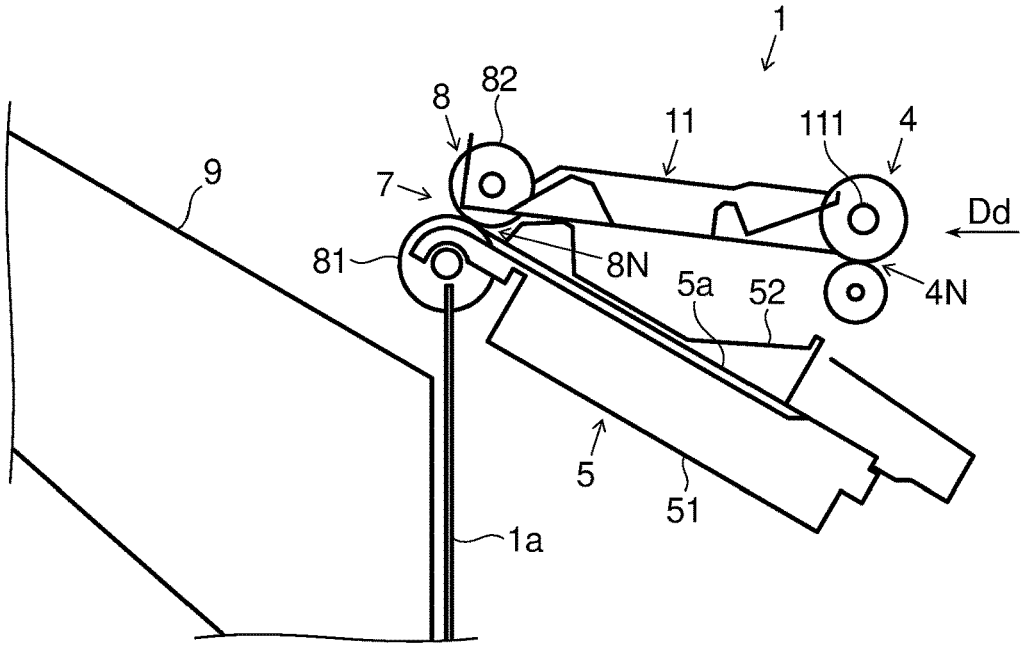
FIG. 2 is a partial sectional front view showing a vicinity of a processing tray of a sheet post-processor shown in FIG. 1.

Next, a description is given of a configuration of the sheet post-processor 1. FIG. 2 is a partial sectional front view showing a vicinity of a processing tray 5 of the sheet post-processor 1 shown in FIG. 1. In the following description of the sheet post-processor 1, a direction directed from a right side to a left side in FIG. 1 and FIG. 2 is referred to as a "sheet discharge direction" and shown by an arrow Dd in the drawings following FIG. 2. Furthermore, a "sheet width direction" orthogonal to the sheet discharge direction is a direction perpendicular to planes of FIG. 1 and FIG. 2 and shown by an arrow Dw in the drawings following FIG. 2.

As shown in FIG. 1 and FIG. 2, the sheet post-processor 1 includes a sheet conveyance inlet 2, a sheet discharge path 3, an intermediate roller pair 4, the processing tray 5, a post-processing unit 6, a sheet discharge port 7, a discharge roller pair 8, a discharge tray 9, and a post-processing control portion 10.

The sheet conveyance inlet 2 is provided to be open on the side surface of the sheet post-processor 1 opposite to the image forming apparatus 201. The sheet S conveyed from the image forming apparatus 201 toward the sheet post-processor 1 passes through the sheet conveyance inlet 2 to be conveyed into the sheet post-processor 1.

The sheet discharge path 3 extends laterally from the sheet conveyance inlet 2 to above the processing tray 5 in a direction away from the image forming apparatus 201 (leftward in FIG. 1). The sheet conveyance inlet 2 is located at an upstream end of the sheet discharge path 3 in a sheet discharge direction Dd.

The intermediate roller pair 4 is arranged, in the sheet discharge path 3, on a downstream side of an after-mentioned perforation portion 61 in the sheet discharge direction Dd. A rotation axis of the intermediate roller pair 4 extends along a sheet width direction Dw. A plurality of intermediate roller pairs 4 are provided along the sheet width direction Dw at a distance from each other. The intermediate roller pairs 4 feed out the sheet S being conveyed in the sheet discharge path 3 toward the sheet discharge port 7 provided on a further downstream side in the sheet discharge direction Dd.

The processing tray 5 is arranged below a downstream part of the sheet discharge path 3 in the sheet discharge direction Dd. In other words, the processing tray 5 is located immediately below a downstream side beyond the intermediate roller pairs 4 in the sheet discharge direction Dd. A sheet placement surface 5*a* of the processing tray 5 is inclined upward in a direction toward the downstream side in the sheet discharge direction Dd. A plurality of sheets S conveyed to the processing tray 5 through the sheet discharge path 3 are loaded on the processing tray 5 and subjected to post-processing.

The post-processing unit 6 performs prescribed post-processing with respect to the sheet S being conveyed in the sheet discharge path 3. The post-processing unit 6 includes the perforation portion 61 and a stapling portion 62.

The perforation portion 61 is arranged, in the sheet discharge path 3, between the sheet conveyance inlet 2 and a downstream end of the sheet discharge path 3. By use of the perforation portion 61, the sheet post-processor 1 is capable of performing a perforation process with respect to the sheet S being conveyed in the sheet discharge path 3 to form a punch hole therein.

The stapling portion 62 is arranged on an upstream side of the processing tray 5 in the sheet discharge direction Dd. By use of the stapling portion 62, the sheet post-processor 1 is capable of performing a stapling process (binding process) with respect to a bundle of sheets S loaded on the processing tray 5 to bind the sheet bundle.

The sheet discharge port 7 is arranged on a downstream side of the intermediate roller pairs 4 in the sheet discharge direction Dd and on a downstream side of the processing tray 5 in the sheet discharge direction Dd. The discharge roller pair 8 is arranged at the sheet discharge port 7. The sheet S with respect to which post-processing has been completed on the processing tray 5 is discharged through the sheet discharge port 7 toward the discharge tray 9.

The discharge roller pair 8 is arranged at the sheet discharge port 7. The discharge roller pair 8 discharges the sheet S on the processing tray 5 in the sheet discharge direction Dd. Furthermore, the discharge roller pair 8 discharges the sheet S to the discharge tray 9 through the sheet discharge port 7. A rotation axis of the discharge roller pair 8 extends along the sheet width direction Dw. A plurality of (for example, two) discharge roller pairs 8 are provided along the sheet width direction Dw at a distance from each other. Each of the discharge roller pairs 8 includes a pair of a lower discharge roller 81 and an upper discharge roller 82.

The lower discharge roller 81 is coupled to a discharge roller drive portion (not shown) and is capable of positive rotation for discharging the sheet S toward the discharge tray 9 and reverse rotation for feeding the sheet S toward the processing tray 5. The upper discharge roller 82 contacts the lower discharge roller 81 and thus rotates following rotation of the lower discharge roller 81.

The upper discharge roller 82 is supported to an arm portion 11. The arm portion 11 extends along the sheet discharge direction Dd and rotatably supports the upper discharge roller 82 at one end thereof on its downstream end side in the sheet discharge direction Dd.

The arm portion 11 is supported to the sheet post-processor 1 at one end thereof on its upstream end side in the sheet discharge direction Dd so as to be rotatable about an axis of a rotary shaft 111 extending along the sheet width direction Dw. The arm portion 11 is coupled to an arm drive portion (not shown) and thus is caused to swing in an up-down direction about the axis of the rotary shaft 111, with the one end thereof supporting the upper discharge roller 82 being a free end.

The arm portion 11 swings to cause the upper discharge roller 82 to contact or separate from the lower discharge roller 81. As shown in FIG. 1 and FIG. 2, the upper discharge roller 82 and the lower discharge roller 81 paired therewith contact each other at their respective circumferential surfaces, thus forming a nip 8N for discharging the sheet S through the sheet discharge port 7.

The sheet S discharged through the sheet discharge port 7 by positive rotation of the discharge roller pairs 8 is loaded on the discharge tray 9. Furthermore, when the discharge roller pairs 8 are caused to rotate reversely in a state where the sheet S is held at the nip 8N of each of the discharge roller pairs 8 and an upstream end of the sheet S in the discharge direction Dd is separated from a nip 4N of each of the intermediate roller pairs 4, the sheet S is conveyed to the processing tray 5. That is, in a case of conveying the sheet S to the processing tray 5, the post-processing control portion 10 performs control so that, after a distal end of the sheet S in the discharge direction Dd has passed through the sheet discharge port 7, switchback of the sheet S is performed to convey the sheet S to the processing tray 5.

The discharge tray 9 is arranged below a downstream side of the sheet discharge port 7 in the sheet discharge direction Dd. A sheet placement surface 9*a* of the discharge tray 9 is inclined upward in a direction toward the downstream side in the sheet discharge direction Dd. An upstream end of the discharge tray 9 in the sheet discharge direction Dd is located below the sheet discharge port 7. A sheet receiving wall 1*a* is provided on an upstream side of the discharge tray 9 in the sheet discharge direction Dd. The sheet receiving wall 1*a* extends in a substantially perpendicular direction and in the sheet width direction Dw.

By a tray drive portion (not shown), the discharge tray 9 can be driven to move substantially perpendicularly in the up-down direction. The sheet S discharged through the sheet discharge port 7 by the discharge roller pairs 8 is loaded on the discharge tray 9. The discharge tray 9 is one of final discharge stations for discharging the sheet S in the sheet post-processor 1.

The post-processing control portion 10 includes a CPU, an image processing portion, a storage portion, and other electronic circuits and electronic components (none of these are shown). The post-processing control portion 10 is communicably connected to the main body control portion 212. Under instructions from the main body control portion 212, based on control programs and data stored in the storage portion by use of the CPU, the post-processing control portion 10 controls operations of the various constituent elements provided in the sheet post-processor 1 so as to perform processes related to functions of the sheet post-processor 1. The sheet discharge path 3, the intermediate roller pairs 4, the processing tray 5, the post-processing unit 6, the discharge roller pairs 8, and the discharge tray 9 individually receive instructions from the post-processing control portion 10 to perform post-processing with respect to the sheet S in tandem with each other. The post-processing control portion 10 is one example of the "control portion" according to the present disclosure, and the main body control portion 212 may also be configured to have functions of the "control portion."

Figure 3:
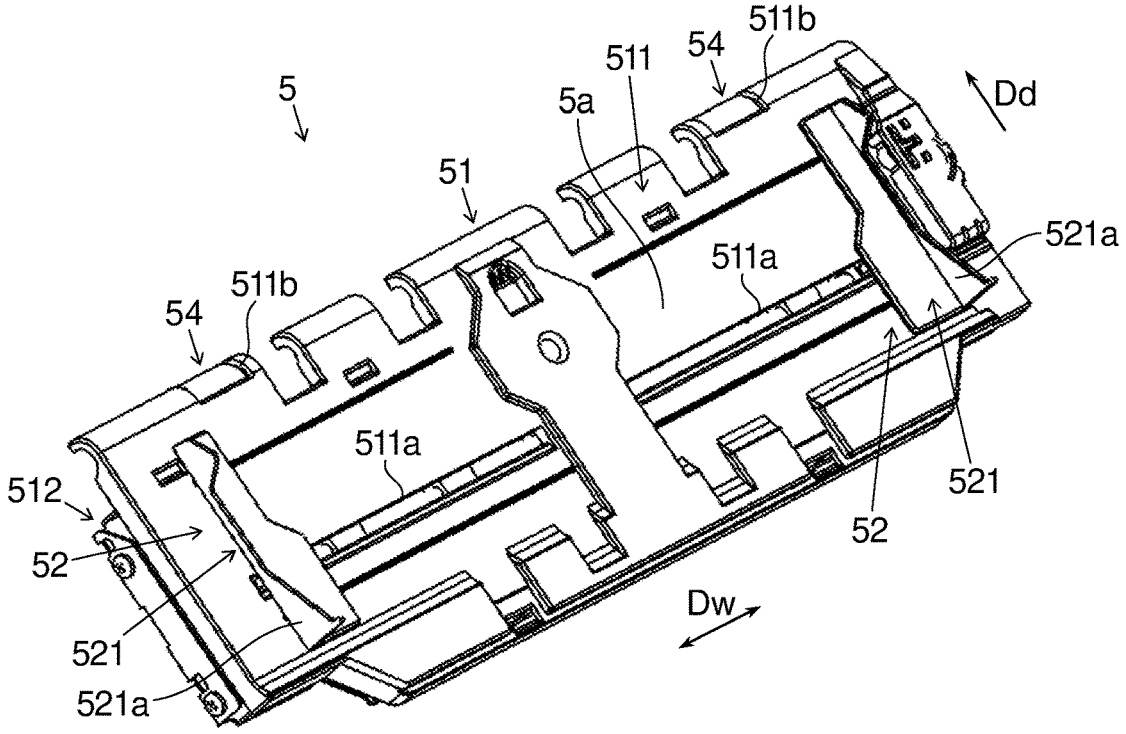
FIG. 3 is a perspective view of the processing tray of the sheet post-processor shown in FIG. 2.
Figure 4:
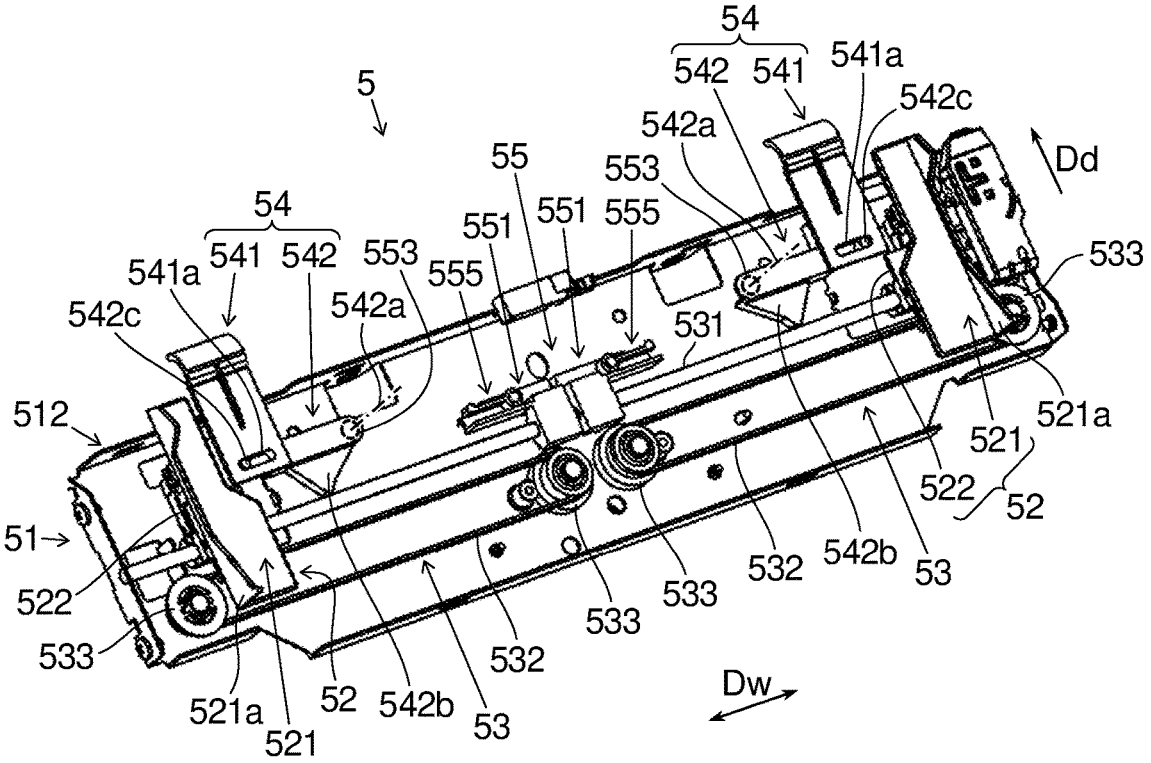
FIG. 4 is a perspective view showing an interior of the processing tray shown in FIG. 3.

Next, a description is given of a detailed configuration of the processing tray 5. FIG. 3 is a perspective view of the processing tray 5 of the sheet post-processor 1 shown in FIG. 2. FIG. 4 is a perspective view showing an interior of the processing tray 5 shown in FIG. 3. As shown in FIG. 3 and FIG. 4, the processing tray 5 includes a chassis 51, a pair of cursor members 52, a pair of cursor drive portions 53, a pair of support members 54, and an interlocking mechanism 55.

As shown in FIG. 3 and FIG. 4, the chassis 51 is substantially in the form of a box and holds the pair of cursor members 52, the cursor drive portions 53, the pair of support members 54, and the interlocking mechanism 55. An upper surface of the chassis 51 is used as the sheet placement surface 5*a*. The sheet placement surface 5*a* is inclined upward in a direction toward the downstream side in the sheet discharge direction Dd. The chassis 51 includes an upper plate portion 511 and a lower box portion 512.

The upper plate portion 511 is arranged in an upper part of the chassis 51 and extends in the sheet discharge direction Dd and in the sheet width direction Dw. The upper plate portion 511 covers an interior space of the lower box portion 512. An upper surface of the upper plate portion 511 is used as the sheet placement surface 5*a*. The upper plate portion 511 has an opening 511*a* and a pair of cutouts 511*b*.

The opening 511*a* is arranged at substantially a center position of the upper plate portion 511 in the sheet discharge direction Dd to extend along the sheet width direction Dw and penetrates the upper plate portion 511 in a direction of a normal to the sheet placement surface 5*a*. The pair of cutouts 511*b* are arranged at a downstream end edge of the upper plate portion 511 in the sheet discharge direction Dd and are concave toward an upstream side in the sheet discharge direction Dd. The pair of cutouts 511*b* are arranged on the left and right, respectively, relative to a center position of the processing tray 5 in the sheet width direction Dw. Each of the pair of support members 54 is arranged in a corresponding one of the pair of cutouts 511*b*.

The lower box portion 512 is arranged in a lower part of the chassis 51 and extends in the sheet discharge direction Dd and in the sheet width direction Dw. The lower box portion 512 is substantially in the form of a box whose upper part is open and has the interior space. The cursor drive portion 53 and the interlocking mechanism 55 are arranged in the interior space of the lower box portion 512.

As shown in FIG. 3, the pair of cursor members 52 are arranged on the sheet placement surface 5*a*, which is an upper surface of the processing tray 5. The pair of cursor members 52 are arranged on the left and right, respectively, relative to the center position of the processing tray 5 in the sheet width direction Dw. Each of the pair of cursor members 52 is connected to a corresponding one of the pair of cursor drive portions 53. Each of the cursor members 52 has an alignment portion 521 and a connection portion 522.

In the chassis 51, the alignment portion 521 is arranged on an upper side beyond the sheet placement surface 5*a*. The alignment portion 521 contacts a lower surface and a side end edge of the sheet S on the processing tray 5. The alignment portion 521 has a side wall part 521*a*.

The side wall part 521*a* is arranged on an outer side of the alignment portion 521 in the sheet width direction Dw. The side wall part 521*a* extends in the up-down direction and in the sheet discharge direction Dd. The side wall part 521*a* contacts the side end edge of the sheet S on the processing tray 5. That is, the pair of cursor members 52 contact the side end edges of the sheet S on the processing tray 5 so as to align a position of the sheet S in the sheet width direction Dw.

The connection portion 522 is arranged below the alignment portion 521 and on a back side of the upper plate portion 511 of the chassis 51. The connection portion 522 is connected to the alignment portion 521 via the opening 511*a*. Furthermore, the connection portion 522 is fixed to an after-mentioned belt 532 of each of the cursor drive portions 53. The pair of cursor drive portions 53 drive the pair of cursor members 52 so that the pair of cursor members 52 are reciprocatable in the sheet width direction Dw.

Figure 5:
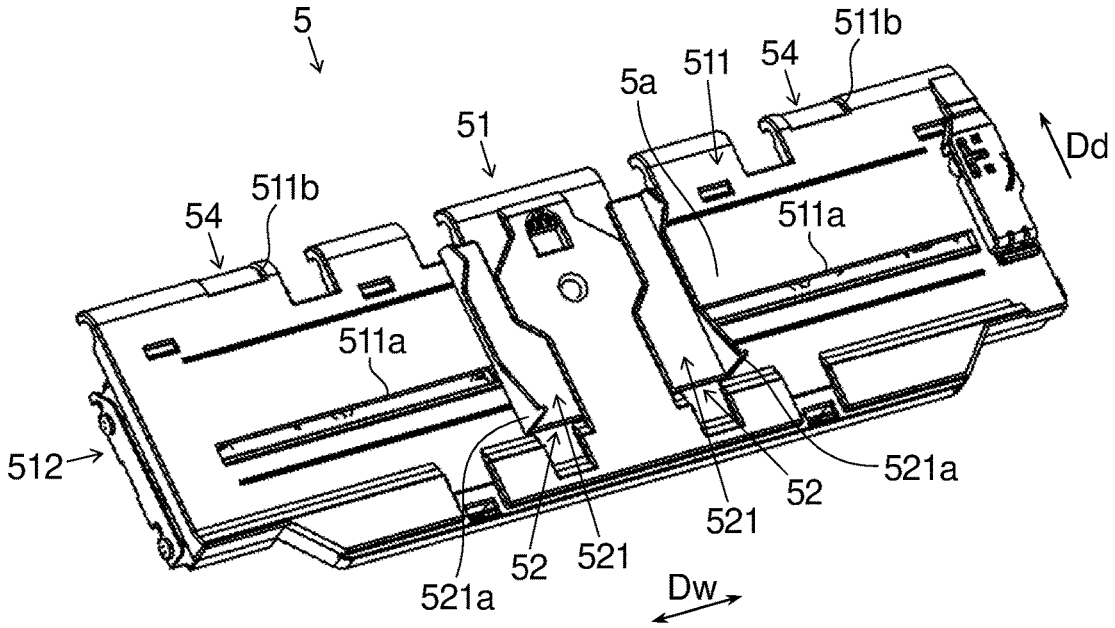
FIG. 5 is a perspective view of the processing tray shown in FIG. 3, illustrating a state where cursor members have been moved to a center position in a sheet width direction.
Figure 6:
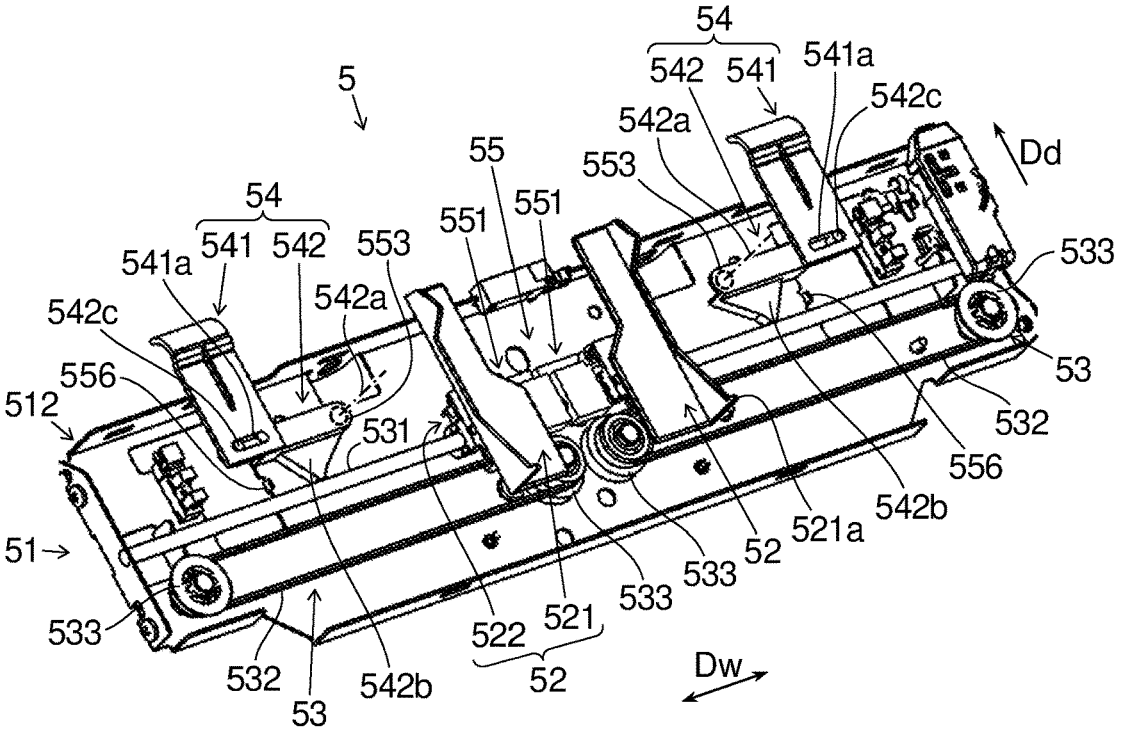
FIG. 6 is a perspective view showing the interior of the processing tray shown in FIG. 5.
Figure 7:
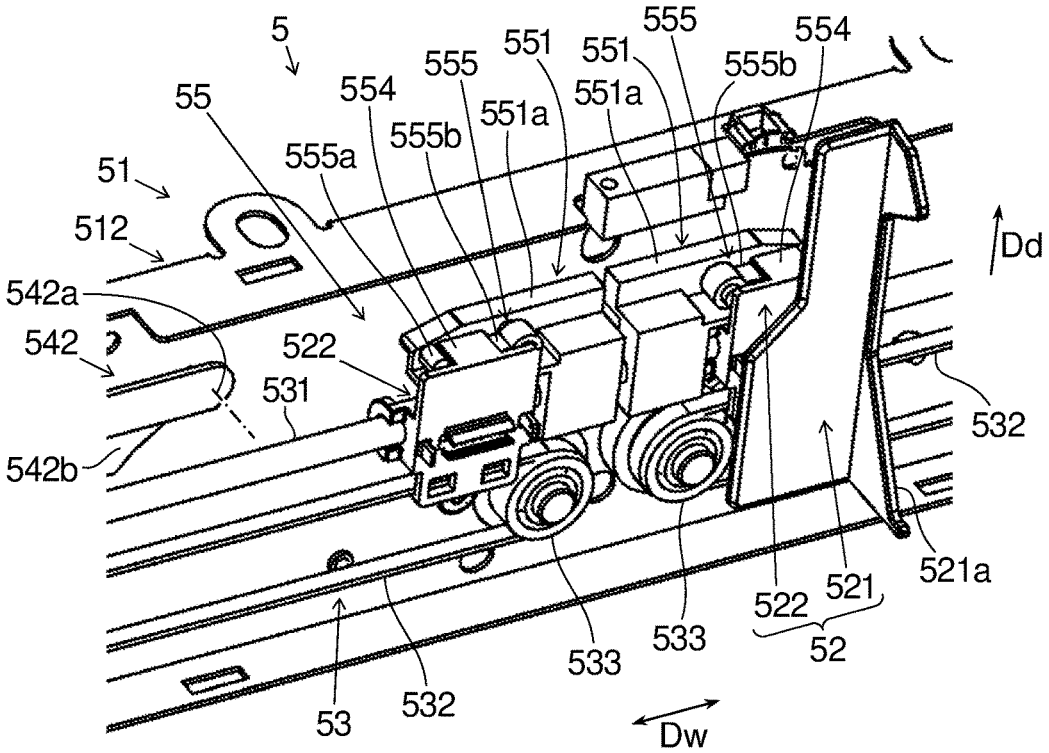
FIG. 7 is a partial enlarged perspective view showing a relevant part in the interior of the processing tray shown in FIG. 6.
Figure 8:
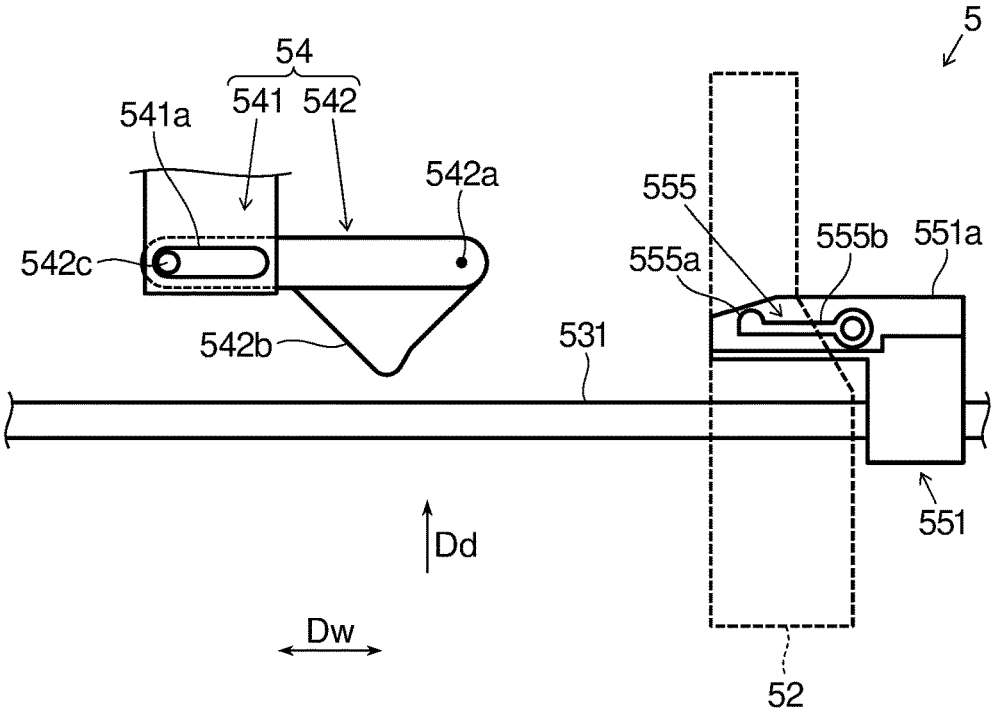
FIG. 8 is a plan view showing how each of support members and a corresponding one of coupling members in the interior of the processing tray shown in FIG. 7 are arranged.

FIG. 5 is a perspective view of the processing tray 5 shown in FIG. 3, illustrating a state where the cursor members 52 have been moved to a center position in the sheet width direction Dw. FIG. 6 is a perspective view showing the interior of the processing tray 5 shown in FIG. 5. FIG. 7 is a partial enlarged perspective view showing a relevant part in the interior of the processing tray 5 shown in FIG. 6. FIG. 8 is a plan view showing how each of the support members 54 and a corresponding one of coupling members 551 in the interior of the processing tray 5 shown in FIG. 7 are arranged. FIG. 7 shows a state where the alignment portion 521 of one (on a left side in the drawing) of the cursor members 52 has been removed.

As shown in FIG. 4, FIG. 5, FIG. 6, and FIG. 7, the pair of cursor drive portions 53 are arranged in an interior of the chassis 51, specifically in the lower box portion 512 thereof. The cursor drive portions 53 are individually provided with respect to the pair of cursor members 52, respectively. Each of the cursor drive portions 53 includes a guide member 531, the belt 532, a pair of pulleys 533, and a drive motor 534 (see FIG. 12).

The guide member 531 is in the shape of a rod extending in the sheet width direction Dw. The guide member 531 penetrates the connection portion 522 of each of the cursor members 52 in the sheet width direction Dw. The connection portion 522 is reciprocatable in an extending direction of the guide member 531, that is, in the sheet width direction Dw.

The belt 532 is an endless belt formed in an oval shape along the sheet width direction Dw so as to be parallel to the guide member 531. The belt 532 is wound over and supported to the pair of pulleys 533. The belt 532 is caused to rotate by the pair of pulleys 533, thus causing the connection portion 522 of each of the cursor members 52 to reciprocate in the sheet width direction Dw along the guide member 531.

The pair of pulleys 533 are arranged side by side in the sheet width direction Dw. The pulleys 533 are mounted to the chassis 51 so as to be rotatable about a rotation axis extending in the direction of the normal to the sheet placement surface 5*a*. One of the pair of pulleys 533 is connected to the drive motor 534 to receive torque therefrom. Thus, the pair of pulleys 533 cause the endless belt 532 wound thereover to rotate.

Figure 12:
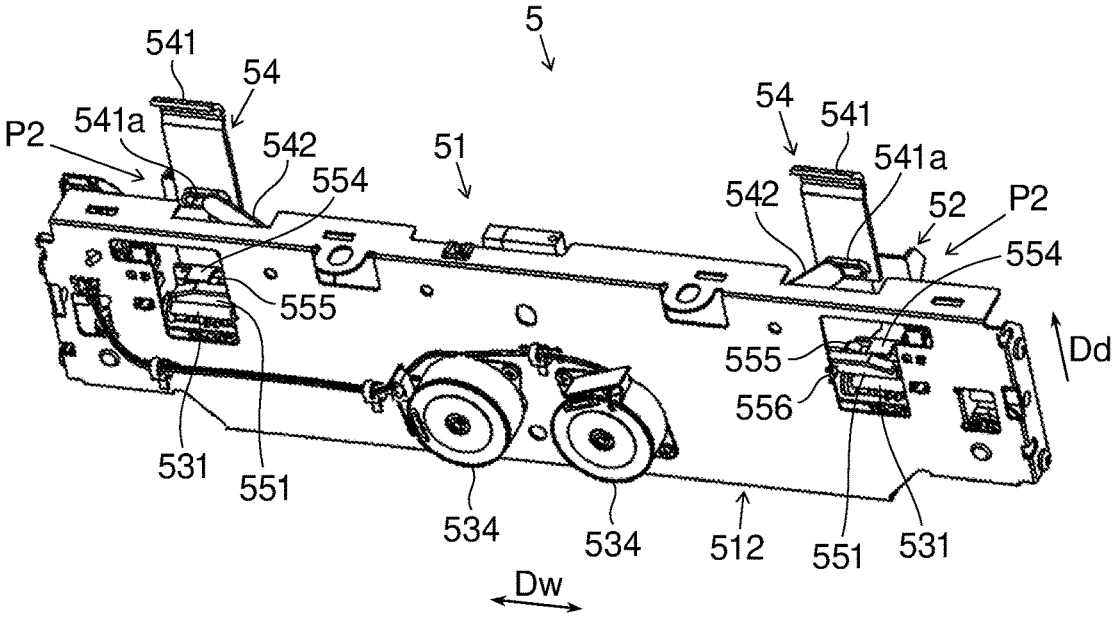
FIG. 12 is a perspective view showing a back surface side of the processing tray shown in FIG. 3, illustrating a state where each of the cursor members has been moved outward in the sheet width direction to a decoupling position at which the each of the cursor members is decoupled from a corresponding one of the coupling members.

The drive motor 534 is arranged on an outer side (a lower side) of the lower box portion 512 of the chassis 51 (see FIG. 12). The drive motor 534 is connected to one of the pair of pulleys 533 and causes the one of the pulleys 533 to rotate. The drive motor 534 is driven to cause the belt 532 to rotate via the pulleys 533, and thus the connection portion 522 of each of the cursor members 52 moves in the sheet width direction Dw along the guide member 531. That is, each of the pair of cursor drive portions 53 drives the drive motor 534 so that a corresponding one of the pair of cursor members 52 is reciprocatable in the sheet width direction Dw.

As shown in FIG. 3, FIG. 4, FIG. 5, and FIG. 6, the pair of support members 54 are arranged at a downstream part of the chassis 51 in the sheet discharge direction Dd. The pair of support members 54 are arranged on the left and right, respectively, relative to the center position of the processing tray 5 in the sheet width direction Dw. The pair of support members 54 are displaced between a retracted position (see FIG. 3 and FIG. 4) retracted from the sheet discharge port 7 to the upstream side in the sheet discharge direction Dd and a protruding position (see FIG. 9 and FIG. 10) protruding to a downstream side beyond the sheet discharge port 7 in the sheet discharge direction Dd, at which upper surfaces thereof are contacted by the sheet S discharged through the sheet discharge port 7. Each of the support members 54 includes a support portion 541 and a link portion 542.

The support portion 541 is arranged at a downstream part of each of the support members 54 in the sheet discharge direction Dd. The support portion 541 is supported to a guide portion (not shown) of the chassis 51 extending along the sheet discharge direction Dd and is reciprocatable in the sheet discharge direction Dd. In a state where the support members 54 are at the retracted position, the support portion 541 is retracted from the sheet discharge port 7 to the upstream side in the sheet discharge direction Dd (see FIG. 3). In a state where the suppose members 54 are at the protruding position, the support portion 541 protrudes to the downstream side beyond the sheet discharge port 7 in the sheet discharge direction Dd (see FIG. 9).

The support portion 541 is contacted at an upper surface thereof by the sheet S discharged through the sheet discharge port 7. The support portion 541 has a groove 541*a* to which the link portion 542 is connected. The groove 541*a* extends in the sheet width direction Dw. The link portion 542 is connected to the groove 541*a*.

The link portion 542 is arranged at an upstream part of each of the support members 54 in the sheet discharge direction Dd. The link portion 542 is arranged adjacently to a downstream side of the guide member 531 in the sheet discharge direction Dd. The link portion 542 is mounted to the chassis 51 so as to be rotatable about a rotation axis 542*a* extending in the direction of the normal to the sheet displacement surface 5*a*. The link portion 542 has a contact part 542*b* and a connection pin 542*c*.

The contact part 542*b* is provided on an upstream side beyond the rotation axis 542*a* in the sheet discharge direction Dd and is adjacent to the guide member 531. The contact part 542*b* contacts an after-mentioned contact surface 551*a* of each of the coupling members 551 of the interlocking mechanism 55. Each of the coupling members 551 contacts the contact part 542*b* to cause the link portion 542 to rotate about the rotation axis 542*a*.

The connection pin 542*c* is in the shape of a shaft extending in the direction of the normal to the sheet placement surface 5*a* and is arranged so as to be radially separated from the rotation axis 542*a*. The connection pin 542*c* is inserted into the groove 541*a* of the support portion 541. Within the groove 541*a*, the connection pin 542*c* is movable in the sheet width direction Dw. The link portion 542 rotates to cause the support portion 541 to reciprocate in the sheet discharge direction Dd via the connection pin 542*c* and the groove 541*a*. That is, the support portion 541 and the link portion 542 of each of the support members 54 are configured as a slider-crank mechanism.

As shown in FIG. 4, FIG. 6, and FIG. 7, the interlocking mechanism 55 is arranged in the interior of the chassis 51. The interlocking mechanism 55 includes a pair of coupling members 551, a pair of first biasing members 552 (see FIG. 10), a pair of second biasing members 553, a pair of coupling pieces 554, a pair of hooks 555, and a pair of decoupling pieces 556.

The coupling members 551 are individually provided with respect to the pair of cursor members 52, respectively. The guide member 531 of each of the cursor drive portions 53 penetrates a corresponding one of the coupling members 551 in the sheet width direction Dw. The pair of coupling members 551 are arranged closer to the center position in the sheet width direction Dw than the connection portion 522 of each of the cursor members 52 is, the connection portion 522 being also penetrated by the guide member 531. The pair of coupling members 551 are reciprocatable in an extending direction of the guide member 531, that is, in the sheet width direction Dw.

As shown in FIG. 7 and FIG. 8, each of the coupling members 551 includes the contact surface 551*a*. The contact surface 551*a* is arranged at a downstream end edge of each of the coupling members 551 in the sheet discharge direction Dd and extends in the sheet width direction Dw and in the direction of the normal to the sheet placement surface 5*a*. When each of the coupling members 551 moves outward in the sheet width direction Dw to approach a corresponding one of the support members 54, at an after-mentioned first position P1 in the sheet width direction Dw, the contact surface 551*a* contacts the contact part 542*b* of the corresponding one of the support members 54.

The pair of first biasing members 552 are formed of an elastic member such as, for example, a spring and are each connected between a corresponding one of the pair of coupling members 551 and the chassis 51. Each of the pair of first biasing members 552 biases a corresponding one of the pair of coupling members 551 toward the center position in the sheet width direction Dw.

The pair of second biasing members 553 are formed of an elastic member such as, for example, a spring and are each connected between a corresponding one of the pair of support members 54 and the chassis 51. Each of the pair of second biasing members 553 biases a corresponding one of the pair of support members 54 toward the retracted position.

As shown in FIG. 7, each of the coupling pieces 554 is individually provided at the connection portion 522 of a corresponding one of the pair of cursor members 52. Each of the coupling pieces 554 is arranged at an upper end of the connection portion 522 and protrudes toward a lower side (a back side) of the processing tray 5. The coupling pieces 554 are formed in the shape of a flat plate extending in the sheet width direction Dw.

As shown in FIG. 4 and FIG. 7, each of the pair of hooks 555 is provided at a corresponding one of the pair of coupling members 551. Each of the hooks 555 is arranged at an upper end of a corresponding one of the coupling members 551 and is formed in the shape of a cantilever protruding outward in the sheet width direction Dw, that is, protruding toward the connection portion 522 of a corresponding one of the cursor members 52. With respect to the sheet discharge direction Dd, each of the hooks 555 is arranged at a position substantially the same as that of a corresponding one of the coupling pieces 554 provided at the connection portion 522.

A distal end 555*a*, which is a free end, of each of the pair of hooks 555 in the sheet width direction Dw swings substantially in the sheet discharge direction Dd. Each of the hooks 555 has a concave 555*b*.

The concave 555*b* is arranged closer to the center position in the sheet width direction Dw than the distal end 555*a* of each of the hooks 555 is so as to be proximal relative to the distal end 555*a*. The concave 555*b* is concave from a downstream end edge of each of the hooks 555 toward the upstream side in the sheet discharge direction Dd.

Each of the hooks 555 and the connection portion 522 approach each other so that a corresponding one of the coupling pieces 554 contacts the distal end 555*a*, thus causing the each of the hooks 555 to be elastically deformed toward the upstream side in the sheet discharge direction Dd into a curved shape. When the each of the hooks 555 and the connection portion 522 further approach each other, the corresponding one of the coupling pieces 554 passes over the distal end 555*a* of the each of the hooks 555 to be fitted in the concave 555*b*.

In a case where each of the hooks 555 and the connection portion 522 separate from each other, a corresponding one of the coupling pieces 554 contacts the distal end 555*a*, thus causing the each of the hooks 555 to be elastically deformed toward the upstream side in the sheet discharge direction Dd into a curved shape. When the each of the hooks 555 and the connection portion 522 further separate from each other, the corresponding one of the coupling pieces 554 passes over the distal end 555*a* of the each of the hooks 555 to be detached from the concave 555*b*.

In the foregoing manner, each of the pair of hooks 555 swings to be coupled to or decoupled from a corresponding one of the pair of coupling pieces 554. Specifically, when contacting a corresponding one of the pair of coupling pieces 554, each of the pair of hooks 555 swings to be coupled to the corresponding one of the pair of coupling pieces 554, and when separating from the corresponding one of the pair of coupling pieces 554, the each of the pair of hooks 555 swings to be decoupled from the corresponding one of the pair of coupling pieces 554.

As shown in FIG. 4 and FIG. 6, each of the pair of decoupling pieces 556 is provided on each outer side in the sheet width direction Dw in the chassis 51. The decoupling pieces 556 are arranged on an inner surface of the lower box portion 512 of the chassis 51 and protrude toward an upper side (a front side) of the processing tray 5. The decoupling pieces 556 are formed in the shape of a flat plate extending in the sheet discharge direction Dd.

Each of the pair of decoupling pieces 556 is contacted by a corresponding one of the pair of coupling members 551 moving outward from the center position in the sheet width direction Dw. Thus, each of the decoupling pieces 556 prevents a corresponding one of the coupling members 551 from moving outward beyond an after-mentioned second position P2 in the sheet width direction Dw.

When not in use, the pair of support members 54 are displaced to the retracted position (see FIG. 3 and FIG. 4). At this time, each of the pair of coupling members 551 is biased by a corresponding one of the pair of first biasing members 552 so as to be located at the center position of the processing tray 5 in the sheet width direction Dw as shown in FIG. 4.

In no case is each of the coupling members 551 coupled to a corresponding one of the cursor members 52 unless the cursor members 52 move to the center position of the processing tray 5 in the sheet width direction Dw. That is, in a state where the support members 54 are retracted and not in use, the cursor members 52 are capable of aligning a position of the sheet S at any respective positions on outer sides relative to the center position of the processing tray 5 in the sheet width direction Dw.

In a case of using the support members 54, as shown in FIG. 5, first, the pair of cursor members 52 are moved to the center position of the processing tray 5 in the sheet width direction Dw. Thus, as shown in FIG. 6 and FIG. 7, each of the pair of coupling members 551 is coupled to a corresponding one of the pair of cursor members 52. At this time, each of the hooks 555 contacts a corresponding one of the coupling pieces 554 and thus is caused to swing, causing the corresponding one of the coupling pieces 554 to be fitted in the concave 555*b*, so that the each of the hooks 555 is coupled to the corresponding one of the coupling pieces 554.

Figure 9:
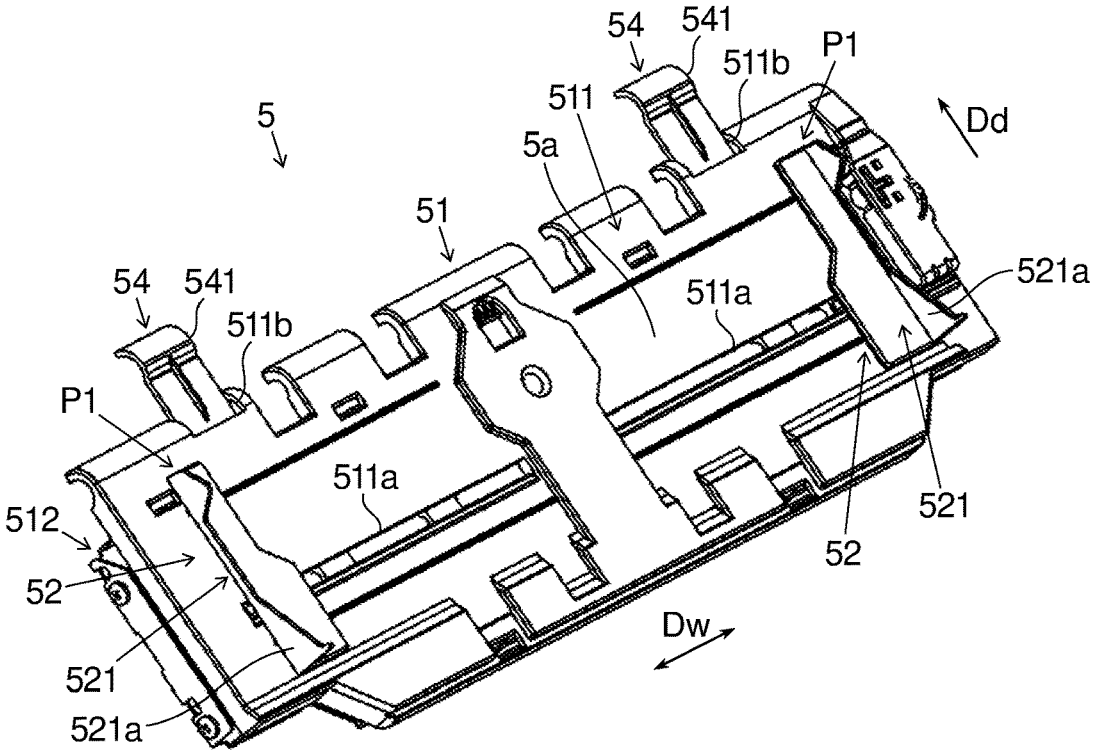
FIG. 9 is a perspective view of the processing tray shown in FIG. 3, illustrating a state where the cursor members have been moved outward in the sheet width direction so as to displace the support members to a protruding position.
Figure 10:
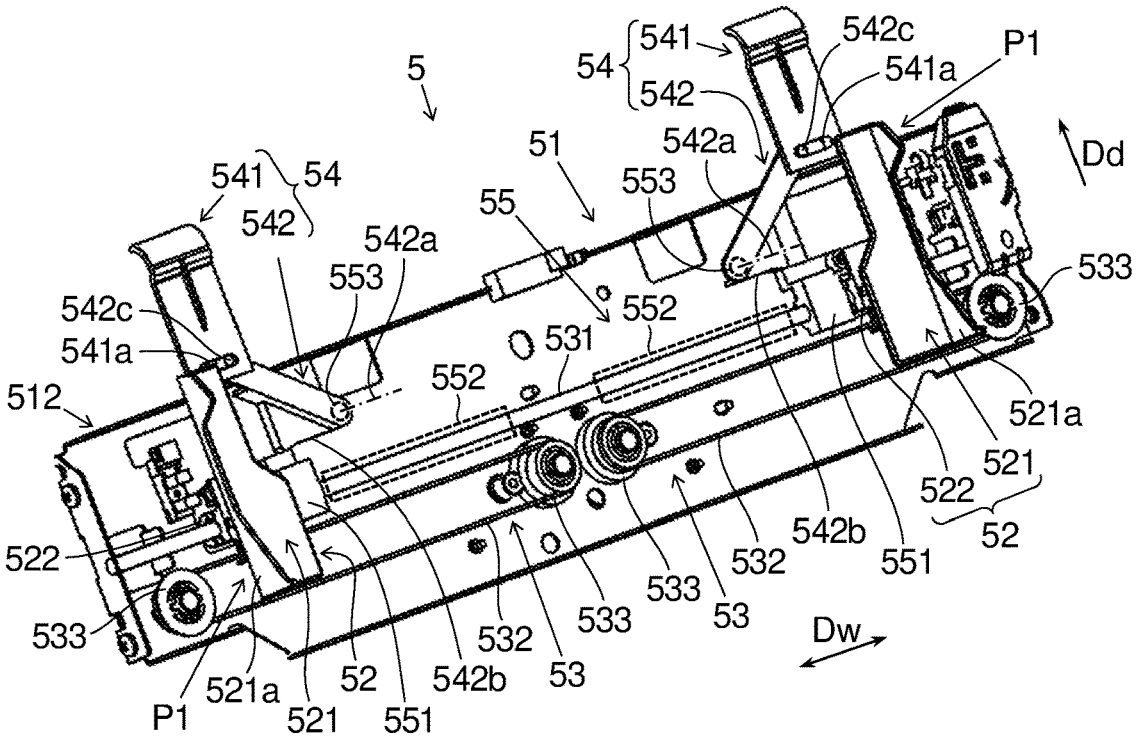
FIG. 10 is a perspective view showing the interior of the processing tray shown in FIG. 9.
Figure 11:
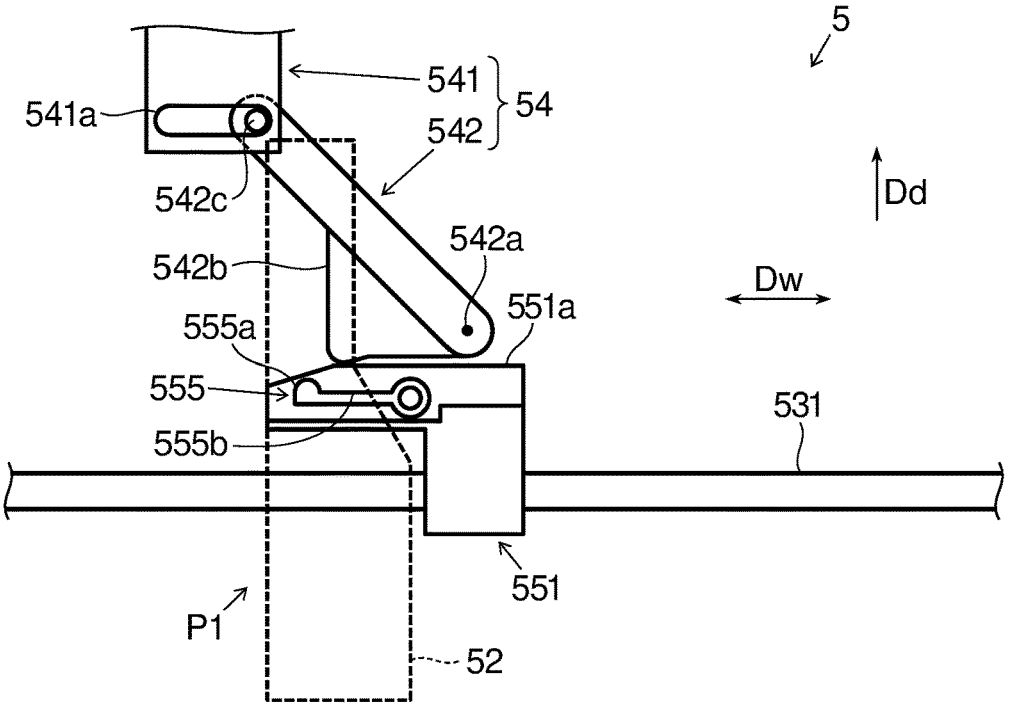
FIG. 11 is a plan view showing how each of the support members and a corresponding one of the coupling members in the interior of the processing tray shown in FIG. 10 are arranged.
Figure 13:
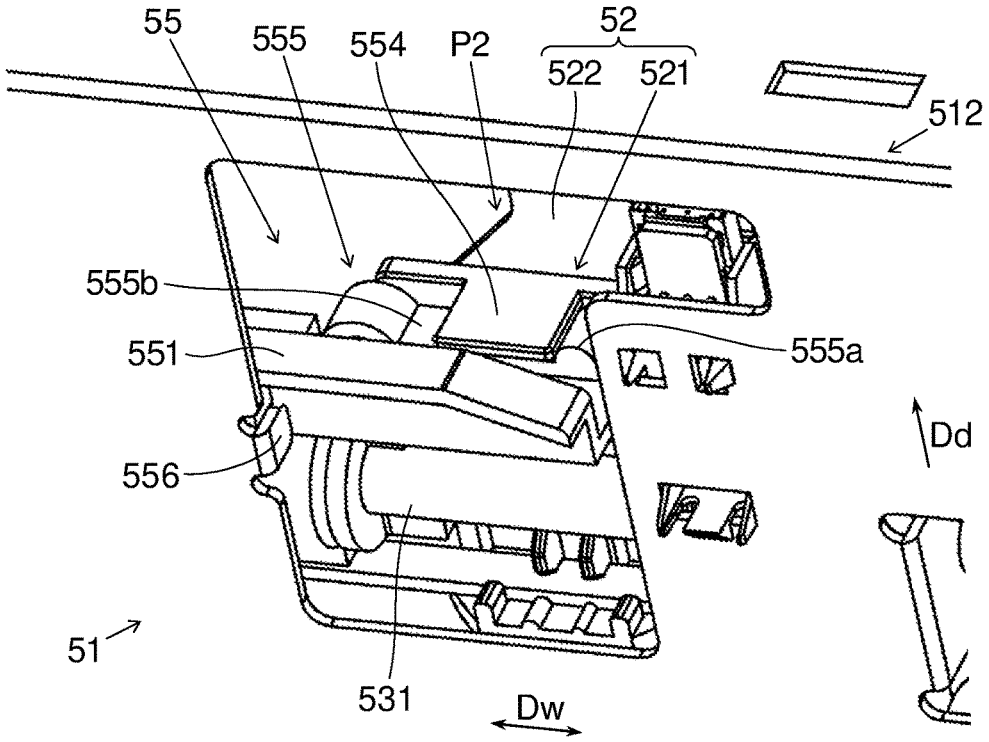
FIG. 13 is a partial enlarged perspective view showing a relevant part on the back surface side of the processing tray shown in FIG. 12.
Figure 14:
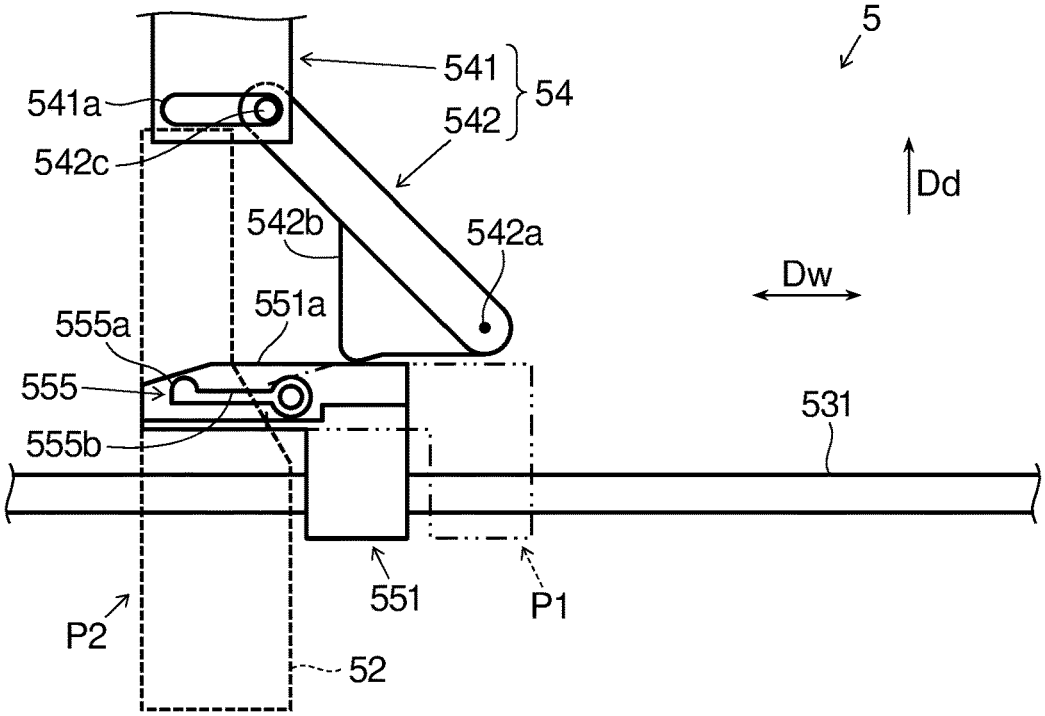
FIG. 14 is a plan view showing how each of the support members and a corresponding one of the coupling members in the interior of the processing tray shown in FIG. 13 are arranged.

FIG. 9 is a perspective view of the processing tray 5 shown in FIG. 3, illustrating a state where the cursor members 52 have been moved outward in the sheet width direction Dw so as to displace the support members 54 to the protruding position. FIG. 10 is a perspective view showing the interior of the processing tray 5 shown in FIG. 9. FIG. 11 is a plan view showing how each of the support members 54 and a corresponding one of the coupling members 551 in the interior of the processing tray 5 shown in FIG. 10 are arranged. FIG. 12 is a perspective view showing a back surface side of the processing tray 5 shown in FIG. 3, illustrating a state where each of the cursor members 52 has been moved outward in the sheet width direction Dw to a decoupling position (second position P2) at which the each of the cursor members 52 is decoupled from a corresponding one of the coupling members 551. FIG. 13 is a partial enlarged perspective view showing a relevant part on the back surface side of the processing tray 5 shown in FIG. 12. FIG. 14 is a plan view showing how each of the support members 54 and a corresponding one of the coupling members 551 in the interior of the processing tray 5 shown in FIG. 13 are arranged.

When each of the pair of cursor members 52, to which a corresponding one of the pair of coupling members 551 is individually coupled, is moved to the first position P1 on each outer side in the sheet width direction Dw in the processing tray 5, as shown in FIG. 10 and FIG. 11, the corresponding one of the pair of coupling members 551 contacts the contact part 542*b* of a corresponding one of the pair of support members 54. Thus, as shown in FIG. 9 and FIG. 10, the link portion 542 rotates to cause the support portion 541 to move to the downstream side in the sheet discharge direction Dd, and thus the corresponding one of the pair of support members 54 is displaced to the protruding position. That is, each of the pair of coupling members 551 contacts a corresponding one of the pair of support members 54 so as to displace the corresponding one of the pair of support members 54 to the protruding position.

When each of the pair of cursor members 52, to which a corresponding one of the pair of coupling members 551 is individually coupled, is moved further to the second position P2 on each outer side beyond the first position P1 in the sheet width direction Dw in the processing tray 5 (see FIG. 14), as shown in FIG. 12 and FIG. 13, the corresponding one of the pair of coupling members 551 contacts a corresponding one of the decoupling pieces 556. Thus, the corresponding one of the pair of coupling members 551 is prevented from moving outward beyond the second position P2 in the sheet width direction Dw and is decoupled from the each of the pair of cursor members 52. At this time, each of the hooks 555 swings to cause a corresponding one of the coupling pieces 554 to be detached from the concave 555*b* and thus is decoupled from the corresponding one of the coupling pieces 554. That is, when each of the pair of cursor members 52 moves to the second position P2 in the sheet width direction Dw, a corresponding one of the pair of decoupling pieces 556 decouples a corresponding one of the pair of hooks 555 from a corresponding one of the pair of coupling pieces 554.

Each of the pair of coupling members 551 is biased by a corresponding one of the pair of first biasing members 552, and thus when decoupled from a corresponding one of the pair of cursor members 52, the each of the pair of coupling members 551 moves to the center position in the sheet width direction Dw as shown in FIG. 4. Thus, as shown in FIG. 3 and FIG. 4, the each of the pair of coupling members 551 separates from a corresponding one of the pair of support members 54 so as to displace the corresponding one of the pair of support members 54 to the retracted position.

As described above, the interlocking mechanism 55 causes the pair of support members 54 to be displaced to the protruding position or the retracted position in accordance with movement of the pair of cursor members 52. The interlocking mechanism 55 includes, in the processing tray 5, the pair of coupling members 551 arranged so as to be reciprocatable in the sheet width direction Dw. Each of the pair of coupling members 551 is coupled to or decoupled from a corresponding one of the pair of cursor members 52 in accordance with movement of the corresponding one of the pair of cursor members 52. Further, in a state of being coupled to the corresponding one of the pair of cursor members 52, the each of the pair of coupling members 551 contacts a corresponding one of the pair of support members 54 so as to displace the corresponding one of the pair of support members 54 to the protruding position, and in a state of being decoupled from the corresponding one of the pair of cursor members 52, the each of the pair of coupling members 551 separates from the corresponding one of the pair of support members 54 so as to displace the corresponding one of the pair of support members 54 to the retracted position.

According to this configuration, each of the pair of coupling members 551 is coupled to or decoupled from a corresponding one of the pair of cursor members 52, and thus a corresponding one of the pair of support members 54 can be displaced to the protruding position or the retracted position in accordance with movement of the corresponding one of the pair of cursor members 52. When each of the pair of coupling members 551 is not coupled to a corresponding one of the pair of cursor members 52, the corresponding one of the pair of cursor members 52 can be moved independently of a corresponding one of the support members 54. Furthermore, since the pair of support members 54 can be displaced in accordance with movement of the pair of cursor members 52, there is no need for a dedicated drive source. Accordingly, the need for a dedicated drive source is eliminated, and the sheet S can be supported on the downstream side of the processing tray 5 in the sheet discharge direction Dd at any timing as required.

Furthermore, as described above, when each of the pair of cursor members 52 moves to the center position in the sheet width direction Dw, a corresponding one of the pair of coupling members 551 is coupled to the each of the pair of cursor members 52, and when the each of the pair of cursor members 52 moves to the first position P1 on each outer side in the sheet width direction Dw, the corresponding one of the pair of coupling members 551 contacts a corresponding one of the pair of support members 54 so as to displace the corresponding one of the pair of support members 54 to the protruding position. Furthermore, when the each of the pair of cursor members 52 moves to the second position P2 on each outer side beyond the first position P1 in the sheet width direction Dw, the corresponding one of the pair of coupling members 551 is decoupled from the each of the pair of cursor members 52 and thus moves to the center position in the sheet width direction D2, so that the corresponding one of the pair of coupling members 551 separates from the corresponding one of the pair of support members 54 so as to displace the corresponding one of the pair of support members 54 to the retracted position.

According to this configuration, each of the pair of cursor members 52 is moved to the center position or the second position P2 on each outer side in the sheet width direction Dw, and thus a corresponding one of the pair of coupling members 551 can be coupled to or decoupled from the each of the pair of cursor members 52. That is, merely by movement of the pair of cursor members 52, the pair of support members 54 can be displaced to the protruding position or the retracted position as required.

The first position P1 is a receiving position for receiving the sheet S at which each of the pair of cursor members 52 is positioned when the sheet S is conveyed to the processing tray 5. According to this configuration, when the sheet S is to be conveyed to the processing tray 5, the pair of support members 54 can be displaced to the protruding position.

Furthermore, the interlocking mechanism 55 includes the pair of coupling members 551, the pair of first biasing members 552, the pair of second biasing members 553, the pair of coupling pieces 554, the pair of hooks 555, and the pair of decoupling pieces 556, which are configurated as above. According to this configuration, when each of the pair of cursor members 52 moves to the center position in the sheet width direction Dw, a corresponding one of the pair of coupling members 551 can be easily coupled to the each of the pair of cursor members 52. When each of the pair of cursor members 52 moves further to the second position P2 on each outer side in the sheet width direction Dw, a corresponding one of the pair of coupling members 551 can be easily decoupled from the each of the pair of cursor members 52.

The post-processing control portion 10 transmits a control signal to the drive motor 534 of each of the cursor drive portions 53 so as to control movement of the pair of cursor members 52. Further, based on a type of the sheet S to be conveyed to the processing tray 5, by use of the pair of cursor members 52, the post-processing control portion 10 operates the interlocking mechanism 55 to displace the pair of support members 54 to the protruding position. According to this configuration, in a case of conveying the sheet S, which has been conveyed to the location of the sheet discharge port 7, to the processing tray 5 by reverse rotation of the discharge roller pairs 8, it is possible to suppress a phenomenon in which the sheet S becomes partly caught in the sheet discharge port 7. The post-processing control portion 10 receives in advance information on the type of the sheet S from the main body control portion 212.

Figure 15:
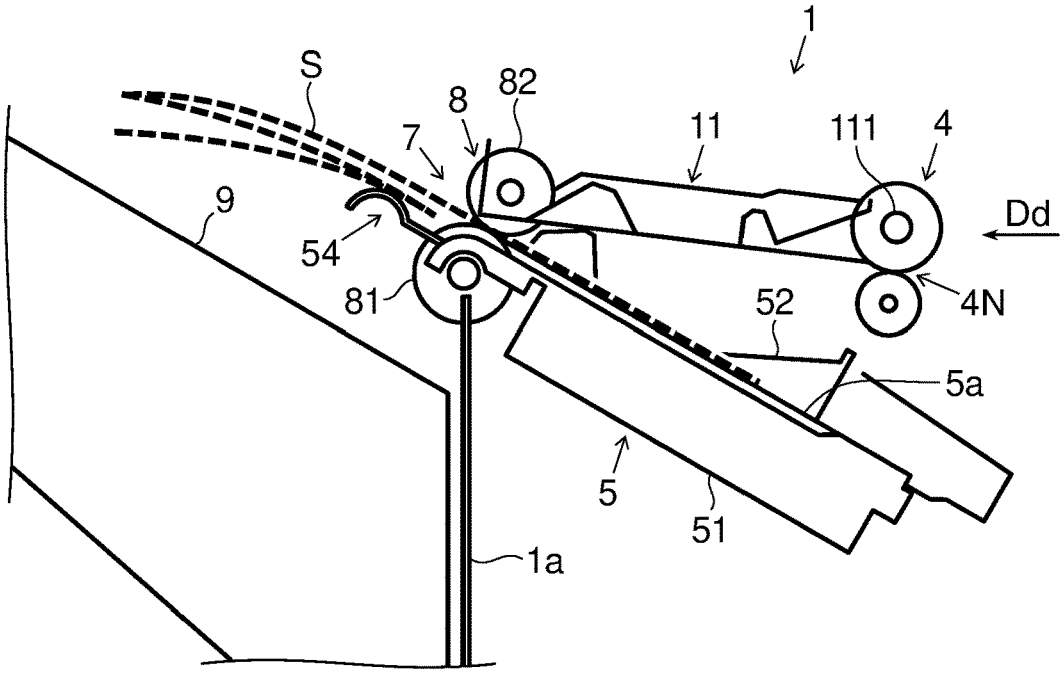
FIG. 15 is a partial sectional front view showing the vicinity of the processing tray shown in FIG. 2, illustrating a state where a sheet bent in a Z-shape has been conveyed to the processing tray.

FIG. 15 is a partial sectional front view showing the vicinity of the processing tray 5 shown in FIG. 2, illustrating a state where a sheet S bent in a Z-shape has been conveyed to the processing tray 5. For example, in a case where the sheet S conveyed to the processing tray 5 is bent in a Z-shape in a cross section as viewed from the sheet width direction Dw, the post-processing control portion 10 performs control so that the pair of support members 54 are displaced to the protruding position. According to this configuration, it is possible to suppress a phenomenon in which a Z-shaped part of the sheet S becomes caught in the sheet discharge port 7.

Figure 16:
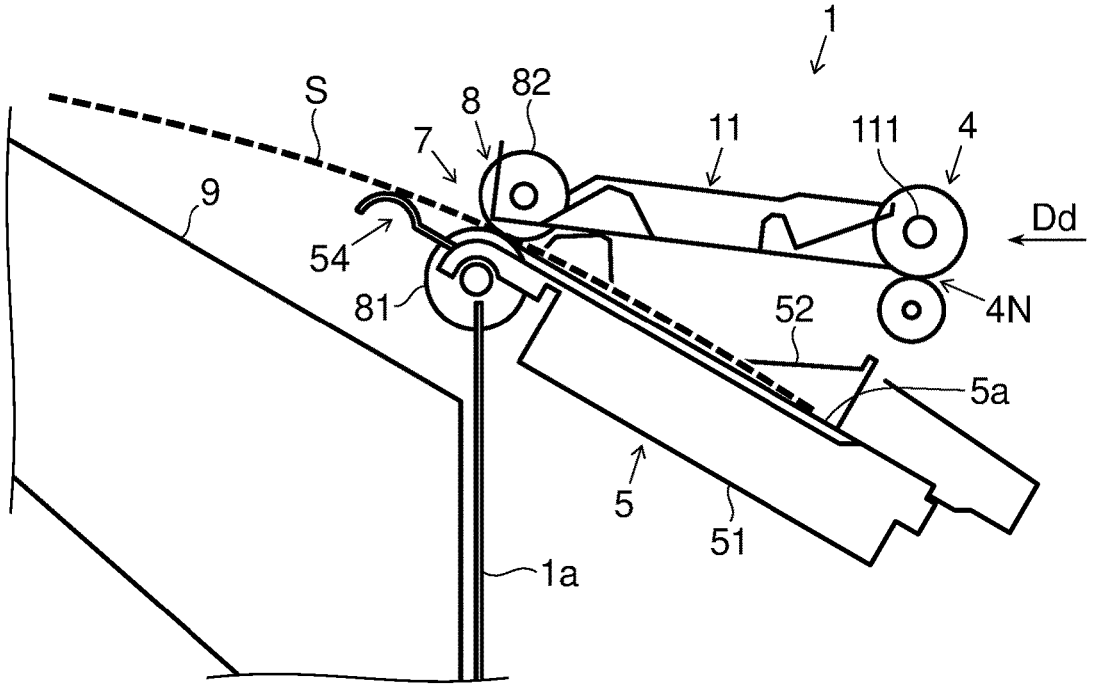
FIG. 16 is a partial sectional front view showing the vicinity of the processing tray shown in FIG. 2, illustrating a state where a sheet of a size longer than that of the processing tray has been conveyed to the processing tray.

FIG. 16 is a partial sectional front view showing the vicinity of the processing tray 5 shown in FIG. 2, illustrating a state where a sheet S of a size longer than that of the processing tray 5 has been conveyed to the processing tray 5. For example, in a case where the sheet S conveyed to the processing tray 5 is of a size longer than the length of the processing tray 5 in the sheet discharge direction Dd, the post-processing control portion 10 performs control so that the pair of support members 54 are displaced to the protruding position. According to this configuration, it is possible to suppress a phenomenon in which the sheet S hangs outside the sheet discharge port 7 over a wide area and becomes caught in the sheet discharge port 7.

Now, a description is given of an example of conveying the sheet S to the processing tray 5 in a case where post-processing is performed, on the processing tray 5, with respect to each sheet bundle composed of a plurality of sheets S, at least the first one of which is a sheet S bent in a Z-shape or a sheet S of a size longer than that of the processing tray 5.

The processing tray 5 is configured so that, when each of the pair of cursor members 52 moves to the receiving position (first position P1) shifted outward in the sheet width direction Dw by, for example, 6 mm from the position of a corresponding one of side end edges of the sheet S, the each of the pair of cursor members 52 contacts a corresponding one of the pair of support members 54 via a corresponding one of the pair of coupling members 551, so that the corresponding one of the pair of support members 54 is displaced to the protruding position. Furthermore, the processing tray 5 is configured so that, when each of the pair of cursor members 52 moves to the decoupling position (second position P2) shifted outward in the sheet width direction Dw by, for example, 10 mm from the position of a corresponding one of the side end edges of the sheet S, a corresponding one of the pair of coupling members 551 contacts a corresponding one of the pair of decoupling pieces 556 and thus is decoupled from the each of the pair of cursor members 52, so that a corresponding one of the pair of support members 54 is displaced to the retracted position.

Before a sheet bundle of sheets S, at least the first one of which is a sheet S bent in a Z-shape or a sheet S of a size longer than that of the processing tray 5, is partly received in the processing tray 5, the post-processing control portion 10 performs control so that each of the pair of coupling members 551 is coupled to a corresponding one of the pair of cursor members 52. Further, the post-processing control portion 10 performs control so that the corresponding one of the pair of cursor members 52 moves to the receiving position (first position P1) shifted outward in the sheet width direction Dw by 6 mm from the position of a corresponding one of side end edges of the sheet S so that a corresponding one of the pair of support members 54 is displaced to the protruding position. In this state, the post-processing control portion 10 performs control so that the first one of the sheets S is conveyed to the processing tray 5.

Upon the first sheet S being conveyed to the processing tray 5, the post-processing control portion 10 performs control so that each of the pair of cursor members 52 moves to an alignment position on each inner side beyond the receiving position in the sheet width direction Dw and contacts a corresponding one of side end edges of the sheet S so as to align a position of the sheet S in the sheet width direction Dw.

Subsequently, the post-processing control portion 10 performs controls so that each of the pair of cursor members 52 moves to the decoupling position (second position P2) shifted outward in the sheet width direction Dw by 10 mm from the position of a corresponding one of the side end edges of the sheet S and thus is decoupled from a corresponding one of the pair of coupling members 551, so that a corresponding one of the pair of support members 54 is displaced to the retracted position. The post-processing control portion 10 performs control so that the each of the pair of cursor members 52 moves again to the receiving position (first position P1) and the second one of the sheets S is conveyed to the processing tray 5.

Upon the second sheet S being conveyed to the processing tray 5, the post-processing control portion 10 performs control so that each of the pair of cursor members 52 moves to the alignment position on each inner side beyond the receiving position in the sheet width direction Dw and contacts a corresponding one of side end edges of the sheet S so as to align the position of the sheet S in the sheet width direction Dw.

Subsequently, the post-processing control portion 10 performs control so that each of the pair of cursor members 52 moves outward in the sheet width direction Dw by 10 mm from the position of a corresponding one of the side end edges of the sheet S. For the third or any subsequent one of the sheets S, the post-processing control portion 10 repeatedly performs control so that each of the pair of cursor members 52 moves outward in the sheet width direction Dw by 10 mm from the position of a corresponding one of side end edges of the sheet S, the sheet S is conveyed to the processing tray 5, and the each of the pair of cursor members 52 contacts the corresponding one of side end edges of the sheet S so as to align the position of the sheet S in the sheet width direction Dw.

Upon the last one of the sheets S being conveyed to the processing tray 5 to complete the sheet bundle, the post-processing control portion 10 performs control so that each of the pair of cursor members 52 moves to a discharge position shifted outward in the sheet width direction Dw by, for example, 2 mm from the alignment position, and thus the sheet bundle is discharged to the discharge tray 9 by the discharge roller pairs 8.

As described above, in a case of conveying and loading the sheet S on the processing tray 5, the post-processing control portion 10 performs control so that, after a distal end of the sheet S in the discharge direction Dd has passed through the sheet discharge port 7, switchback of the sheet S is performed to convey the sheet S to the processing tray 5. Further, in a case of conveying and loading the first one of the sheets S on the processing tray 5, the post-processing control portion 10 performs control so that each of the pair of cursor members 52 moves so as to displace a corresponding one of the pair of support members 54 to the protruding position, and in a case of conveying and loading the second or any subsequent one of the sheets S on the processing tray 5, the post-processing control portion 10 performs control so that the each of the pair of cursor members 52 moves so as to displace the corresponding one of the pair of support members 54 to the retracted position.

According to this configuration, with respect to the first one of the sheets S constituting a sheet bundle, which needs to be supported on the downstream side of the processing tray 5 in the sheet discharge direction Dd, the pair of support members 54 can be displaced to the protruding position, and with respect to any other subsequent one of the sheets S, the pair of support members 54 can be displaced to the retracted position. That is, the pair of support members 54 can be displaced to the protruding position or the retracted position as required.

When there is no need to use the pair of support members 54 as in a case of using a sheet bundle not including a sheet S bent in a Z-shape or a sheet S of a size longer than that of the processing tray 5, the pair of support members 54 are retained at the retracted position. The post-processing control portion 10 performs control so that each of the pair of cursor members 52 moves to the receiving position (first position P1) and the sheet S is conveyed to the processing tray 5. Further, the post-processing control portion 10 performs control so that the each of the pair of cursor members 52 moves to the alignment position so as to align a position of the sheet S in the sheet width direction Dw. Upon a sheet bundle being completed as a result of repeated conveyance and alignment of the sheet S, the post-processing control portion 10 performs control so that the each of the pair of cursor members 52 moves to the discharge position, and thus the sheet bundle is discharged to the discharge tray 9.

Furthermore, according to the above-described configuration, the image forming system 301 includes the sheet post-processor 1 configured as above and the image forming apparatus 201, and thus in the image forming system 301, the pair of support members 54 can be displaced to the protruding position or the retracted position in accordance with movement of the pair of cursor members 52. Further, the pair of support members 54 require no dedicated drive source. Accordingly, in the image forming system 301, there is no need for a dedicated drive source, and the sheet S can be supported on the downstream side of the processing tray 5 in the sheet discharge direction Dd at any timing as required.

While the foregoing has described the embodiment of the present disclosure, the scope of the present disclosure is not limited thereto, and the present disclosure can be implemented by adding various modifications thereto without departing from the spirit of the disclosure.

For example, while in the foregoing embodiment, the image forming apparatus 201 of the image forming system 301 is formed of a monochrome printing image forming apparatus, there is no limitation to an apparatus of this type. The image forming apparatus used may also be, for example, a color printing image forming apparatus.

What is claimed is:

1. A sheet post-processor, comprising:

a processing tray on which a sheet is loaded;

a sheet discharge port that is arranged on a downstream side in a sheet discharge direction relative to the processing tray;

a discharge roller pair that is arranged at the sheet discharge port and discharges the sheet on the processing tray;

a pair of cursor members that is arranged along an upper surface of the processing tray so as to be reciprocatable in a sheet width direction orthogonal to the sheet discharge direction and contacts side end edges of the sheet on the processing tray so as to align a position of the sheet in the sheet width direction;

a pair of support members that is displaced between a retracted position retracted from the sheet discharge port to an upstream side in the sheet discharge direction and a protruding position protruding to a downstream side beyond the sheet discharge port in the sheet discharge direction, at which an upper surface of the pair of support members is contacted by the sheet discharged through the sheet discharge port; and an interlocking mechanism that causes the pair of support members to be displaced to the protruding position or the retracted position in accordance with movement of the pair of cursor members, wherein the interlocking mechanism includes a pair of coupling members that is arranged in the processing tray so as to be reciprocatable in the sheet width direction, the pair of coupling members being coupled to or decoupled from the pair of cursor members in accordance with movement of the pair of cursor members, and in a state of being coupled to the pair of cursor members, the pair of coupling members contacts the pair of support members so as to displace the pair of support members to the protruding position, and in a state of being decoupled from the pair of cursor members, the pair of coupling members separates from the pair of support members so as to displace the pair of support members to the retracted position.

2. The sheet post-processor according to claim 1, wherein when the pair of cursor members moves to a center position in the sheet width direction, the pair of coupling members is coupled to the pair of cursor members, when the pair of cursor members moves to a first position on an outer side in the sheet width direction, the pair of coupling members contacts the pair of support members so as to displace the pair of support members to the protruding position, and when the pair of cursor members moves to a second position on an outer side beyond the first position in the sheet width direction, the pair of coupling members is decoupled from the pair of cursor members and thus moves to the center position in the sheet width direction, so that the pair of coupling members separates from the pair of support members so as to displace the pair of support members to the retracted position.

3. The sheet post-processor according to claim 2, wherein the first position is a receiving position for receiving the sheet at which the pair of cursor members is positioned when the sheet is conveyed to the processing tray.

4. The sheet post-processor according to claim 1, further comprising:

a control portion that controls movement of the pair of cursor members, wherein in a case of conveying and loading a first one of sheets on the processing tray, the control portion performs control so that the pair of cursor members moves so as to displace the pair of support members to the protruding position, and in a case of conveying and loading a second or any subsequent one of the sheets on the processing tray, the control portion performs control so that the pair of cursor members moves so as to displace the pair of support members to the retracted position.

5. The sheet post-processor according to claim 4, wherein the control portion performs control so that, after a distal end of the sheet in the discharge direction has passed through the sheet discharge port, switchback of the sheet is performed to load the sheet on the processing tray.

6. The sheet post-processor according to claim 2, wherein the interlocking mechanism includes:

a pair of first biasing members that biases the pair of coupling members toward the center position in the sheet width direction;

a pair of second biasing members that biases the pair of support members toward the retracted position;

a pair of coupling pieces that is provided at the pair of cursor members;

a pair of hooks that is provided at the pair of coupling members and coupled to or decoupled from the pair of coupling pieces; and a pair of decoupling pieces that is provided on an outer side in the sheet width direction in the processing tray and configured so that when the pair of cursor members moves to the second position in the sheet width direction, the pair of decoupling pieces contacts the pair of coupling members so as to decouple the pair of hooks from the pair of coupling pieces.

7. The sheet post-processor according to claim 1, further comprising:

a control portion that controls movement of the pair of cursor members, wherein, based on a type of the sheet to be conveyed to the processing tray, by use of the pair of cursor members, the control portion operates the interlocking mechanism to displace the pair of support members to the protruding position.

8. The sheet post-processor according to claim 4, wherein in a case where the sheet conveyed to the processing tray is bent in a Z-shape in a cross section as viewed from the sheet width direction, the control portion performs control so that the pair of support members is displaced to the protruding position.

9. The sheet post-processor according to claim 4, wherein in a case where the sheet conveyed to the processing tray is of a size longer than a length of the processing tray in the sheet discharge direction, the control portion performs control so that the pair of support members is displaced to the protruding position.

10. An image forming system, comprising:

the sheet post-processor according to claim 1; and an image forming apparatus that is coupled to the sheet post-processor and is configured to form an image on a sheet and convey the sheet to the sheet post-processor.

* * * * *